US007788952B2

(12) United States Patent
Morrison

(10) Patent No.: US 7,788,952 B2
(45) Date of Patent: Sep. 7, 2010

(54) THREE-DIMENSIONAL FABRIC WITH POROUS LAYER

(76) Inventor: Mary Elizabeth Morrison, C/O Lamination Technologies Limited, Millbeck House, Rossendale, Lancashire BB4 7DQ (GB)

( * ) Notice: Subject to any disclaimer, the term of this patent is extended or adjusted under 35 U.S.C. 154(b) by 1931 days.

(21) Appl. No.: 10/250,730

(22) PCT Filed: Jan. 9, 2002

(86) PCT No.: PCT/GB02/00070

§ 371 (c)(1),
(2), (4) Date: Oct. 15, 2003

(87) PCT Pub. No.: WO02/054896

PCT Pub. Date: Jul. 18, 2002

(65) Prior Publication Data

US 2004/0062910 A1 Apr. 1, 2004

(30) Foreign Application Priority Data

Jan. 9, 2001 (GB) ..... 0100560.2

(51) Int. Cl.
*D04B 21/10* (2006.01)

(52) U.S. Cl. ..... 66/195

(58) Field of Classification Search ..... 66/202, 66/195, 193; 2/81
See application file for complete search history.

(56) References Cited

U.S. PATENT DOCUMENTS

| | | | | |
|---|---|---|---|---|
| 5,131,097 | A * | 7/1992 | Grilliot et al. | 428/920 |
| 5,385,036 | A * | 1/1995 | Spillane et al. | 66/196 |
| 5,572,991 | A | 11/1996 | Grilliot et al. | 128/201.29 |
| 6,105,401 | A * | 8/2000 | Chadeyron et al. | 66/195 |
| 6,630,414 | B1 * | 10/2003 | Matsumoto | 66/195 |
| 6,755,052 | B1 * | 6/2004 | Sytz | 66/196 |
| 6,845,517 | B2 * | 1/2005 | Aldridge et al. | 2/81 |

FOREIGN PATENT DOCUMENTS

| | | |
|---|---|---|
| DE | 31 39 402 | 4/1983 |
| DE | 200 03 097 | 9/2000 |
| FR | 2 623 823 | 6/1989 |
| WO | WO 98/34505 | 8/1998 |

* cited by examiner

*Primary Examiner*—Danny Worrell
(74) *Attorney, Agent, or Firm*—Fox Rothschild LLP; Charles N. Quinn

(57) ABSTRACT

The invention provides a fabric (10) comprising a porous layer (15) that is porous in the direction along the layer, the porous layer including fibers (16) extending across the layer, whereby, in use, fluid (A) is arranged to be driven along the porous layer in the general extent of the layer. The fabric allows heat from a body in contact with the fabric to be carried along the porous layer, thereby efficiently cooling the body. The invention also provides articles comprising the fabric, such as clothing. Advantageously, the fabric is lightweight, flexible and non-bulky, and provides efficient cooling of the body.

58 Claims, 5 Drawing Sheets

THREE-DIMENSIONAL FABRIC WITH POROUS LAYER

The present invention relates to a fabric, as well as to articles incorporating the fabric, particularly, but not exclusively, clothing. The invention also relates to methods of cooling and/or heating the body. The present invention is particularly, although not exclusively, applicable to cooling the bodies of drivers such as rally or racing drivers.

All racing drivers are obliged to wear approved fire resistant clothing. This is to protect them from fire within, or around, their vehicle. The more effective the protection, the more layers of fire resistant fabric are required. Because of this, drivers' overalls are very efficient at retaining heat within the body. This is uncomfortable for the driver, especially where they must wear the overalls for a long period of time (Formula one races, for example) or within an already hot cockpit (Endurance racing, for example).

For rally events in hot countries the problem of retained heat through wearing the mandatory overalls has resulted in drivers and navigators refusing to wear these overalls. They prefer to forego protection against burn injuries in order to avoid the possibility of passing out through fatigue brought about by heat exhaustion.

Producing a suit that will provide full fire protection, whilst preventing the wearer overheating, would prevent drivers having to compromise between safety and comfort.

It will be appreciated that various other occupations, such as fire fighting for example, are also in need of clothing which provides full fire protection whilst preventing the wearer overheating and/or not unduly restricting movement of the wearer.

WO 96/02220 and U.S. Pat. No. 5,014,363 disclose garments which are constructed using rigid rib members to provide ventilation channels within the garment. However, such garments are relatively bulky and inflexible as well as being complex to manufacture.

JP 4209809 discloses a garment with air breathable layers. However, the outer layer is not airtight, and therefore the structure is not effective as a channel for the cooling air. Moreover, an intermediate layer of contacting material is provided between the outer layers requiring to be placed at specified intervals which is relatively inflexible, and the contacting material is also a separately constructed material adding to the complexity of manufacture. U.S. Pat. No. 5,243,706 discloses another garment similar in structure to JP 4209809.

GB 2352959 A discloses a garment with air breathable layers to cool the body. However, it does not have an effective channel for the air to flow. As such, the garment does not provide the desired level of cooling required by the situations described above.

It is an object of the present invention to attempt to overcome at least some of the above or other disadvantages. Various other objects of the present invention will become apparent from the following description.

According to one aspect of the present invention there is provided a fabric comprising a porous layer that is porous in the direction along the layer, the porous layer the general extent of the layer, characterized in that the cross fibres are arranged in a pattern to provide one or more channels through the fabric for preferential fluid flow through the one or more channels in the direction along the layer.

The present invention also provides articles comprising the fabric, such as clothing and a vehicle seat.

According to another aspect of the present invention clothing comprises a porous layer that is porous in the direction along the layer, the porous layer including fibres extending across the layer, whereby, in use, fluid is arranged to be driven along the layer in the general extent of the layer whereby a wearer of the clothing is cooled, characterized in that the cross fibres are arranged in a pattern to provide one or more channels through the fabric for preferential fluid flow through the one or more channels in the direction along the layer.

Advantageously, the fabric is lightweight, flexible and non-bulky, and provides efficient cooling.

The fluid in the porous layer enables heat exchange with a body located adjacent the porous layer. The driven fluid enables, for example, heat from the body to be carried along the porous layer, thereby efficiently cooing the body.

The fabric comprises an upper surface i.e. the face in use further from the body, and, spaced therefrom, a lower surface, i.e. the face in use nearer the body. The porous layer is provided in-between said upper and lower surfaces of the fabric. The fabric is thus three dimensional. The lower surface in use may be adjacent the body, e.g. in contact with the body. The lower surface is preferably permeable to fluid, e.g. air and moisture, thereby to allow moisture, e.g. sweat, and heat from a body, to pass through, into the porous layer. The upper surface may be permeable to fluid, e.g. air and moisture. Alternatively, the upper surface may be impermeable to at least the fluid driven through the porous layer, e.g. air, but allowing another fluid, e.g. moisture, to pass through, as described in more detail below.

The porous layer preferably has located adjacent to it on its upper side, i.e. the side furthest from the body in use, a non-porous or impermeable layer or surface which is substantially impermeable to the fluid driven in the porous layer. Preferably, said impermeable layer is impermeable to air. Thus, the fluid is constrained by said impermeable layer to move along the porous layer. By constraining the fluid in forced flow along the porous layer, such as for the extent of the fabric, cooling efficiency is improved.

The porous layer may include fibres, such as staple fibres or elongate fibres or continuous filaments or monofilament(s). The majority of the fibres may have a greater extent across the porous layer than they do along the porous layer. For instance, where staple fibres are used, the majority of those fibres may extend, from one end to the other, more across the porous layer than they do along the porous layer. The porous layer may have fibres extending across the porous layer either substantially vertical to the plane of the porous layer or at an angle to the layer. The fibres may all be the same. Alternatively more than one type of fibre may be included. The fibre preferably comprises a monofilament. The fibres across the porous layer may comprise polyester monofilament(s) for example. Preferably, the fibre across the layer comprises a single polyester monofilament. The cross fibres may comprise one or both of man made fibres or natural fibres. The cross fibre may also comprise inherently flame retardant fibre, treated flame retardant fibre or a combination of these. An inherent flame retardant monofilament and/or a polyester monofilament is preferred.

The fibres may be knitted or needled or woven together.

The upper and lower surfaces of the fabric may comprises fibres, such as staple fibres or elongate fibres or continuous filaments or monofilament(s). The fibres may all be the same. Alternatively more than one type of fibre may be included. The fibres may be knitted or needled or woven together. Fibres in one layer may be needled or knitted to fibres in another adjacent layer or layers. The fabric comprising the porous layer and its upper and lower surfaces preferably is needled or knitted or woven as a single fabric.

Suitable materials for the fabric upper and lower faces may comprise inherent flame retardant fibres, e.g. Nomex (tradename), treated flame retardant fibres, e.g. Proban (tradename), treated cotton, natural fibres, man made fibres and/or a combination of different fibres in both upper and lower surfaces. Each surface may be the same or different from each other. Inherent flame retardant fibres such as Nomex is preferred for at least one, or preferably both, of the upper and lower surfaces. The surface next to the body preferably includes fibres with wicking properties, which may also be fire retardant. By wicking properties it is meant that the fibres actively encourage or attract moisture, e.g. sweat, from the body into the porous layer.

Any of the fibres may comprise flame retardant fibres, synthetic fibres or natural fibres or any combination thereof. The fabric may be constructed by knitting using flame retardant fibres such as Nomex (trade name). Advantageously, such a fabric has a very high level of fire retardency.

Any of the fibres may be treated or coated with flame retardant treatments or coatings.

The fabric or porous layer may be warp or weft knitted. Using a weft knit is more flexible than warp knitting. Weft knitting the upper and lower surfaces may include a plain knit, single jersey or double jersey and the cross fibres may be knitted into the upper and lower surfaces on an alternative side sequence. The cross fibres can be either straight across the layer or at an angle. Warp knitting may be used for high quantity work. With warp knitting the cross fibres may be at an angle of 90° to the upper and lower faces. The knitting may be chosen depending on the properties e.g. stretch/compression etc. required.

Advantageously, the porous layer may be knitted in one operation where the upper and lower surfaces are knitted simultaneously and the cross fibre passed singly from the upper to the lower surface. The pattern of the cross fibre can be controlled to dictate the number and location of each pass from upper to lower surfaces. The cross fibre may be knitted into each surface as it passes across. Preferably this uses a single yarn and each pass is, a single pass.

A knitting sequence, for weft knitting, may be as follows: (1) stitch loop formation (2) the cross fibre crosses to opposite side and is laid into the opposite side stitch loop (3) the opposite stitch loop is formed (4) the cross fibre is then passed back to the original side and laid into the stitch loop (5) the sequence is then repeated. The cross fibre can be passed over at any point and by control, e.g. computer control, the sequence can be altered to form a different cross fibre pattern, such as channels for example.

At least part of the porous layer may be arranged, in use, to contact the skin of a user over at least part of its extent. Preferably, a porous fabric should contact the skin. Either the porous lower surface of the fabric, or a porous fabric attached thereto, should contact the skin.

Preferably, there is provided a second layer, e.g. a film, that is arranged to constrain the fluid to move through the porous layer in the general extent of the porous layer and that second layer may be located on an outer side of the porous layer with respect to a body which may be the outside of the clothing. The second layer may provide the non-porous or impermeable layer to the upper side of the porous layer referred to above. It will be appreciated that the invention thus also provides a laminate material comprising the fabric and a second layer or film. The laminate thus in use has fluid flowing in the porous layer, the fluid being constrained by the second layer or film so that it travels along the porous layer and does not pass through the sides of the layer. The second layer preferably is substantially impermeable to the fluid, e.g. air impermeable. Preferably, the second layer allows moisture vapour transmission, thereby allowing the body to sweat.

The second layer preferably comprises a hydrophilic layer or membrane which may, in use, be arranged to attract moisture from inside the fabric or clothing out through the hydrophilic layer. The hydrophilic layer may be arranged to constrain fluid flowing in the general extent of the layer within the clothing.

The second layer or film may be flame retardant. Suitable materials for the second film layer are hydrophilic films, or microporous films. These may comprise polyurethane, polyester urethane or PVC films. These may have flame retardant properties. Preferred is a hydrophilic film with flame retardant properties.

The second layer or film may be arranged to be located between two porous layers both of which are porous along the layers and both of which, in use, may be arranged to have fluid driven through them in the general direction of extent of the layer, e.g. to cool a wearer of the clothing.

The laminate may comprise five layers in which (starting from the layer closest the body) one layer comprises the 3D fabric with porous layer, the second layer is fluid impermeable layer which allows moisture vapour transmission, the third layer is another 3D fabric with porous layer, the fourth layer is a fluid impermeable layer which allows moisture vapour transmission and the fifth layer comprises a fabric which protects the outer impermeable layer. The five layer laminate may be arranged for a first fluid, e.g. air, to be circulating in the first porous layer and the second porous layer may be capable of being flooded with an inert gas, such as $CO_2$ or other similar extinguishing material, as a protective measure if engulfed in a fire or high temperature environment. Such an arrangement may be useful for applications such as the fire service where the same freedom of movement as a racing driver may not be needed. By arranging the second porous layer, through which the $CO_2$ could be circulated, above the impermeable layer of the basic two layer laminate, the inner impermeable layer prevents the $CO_2$ touching the body and the inner porous layer further provides insulation against a freezing effect.

The second layer may comprise or incorporate gas and/or chemical resistant properties. This would protect the wearer when working in hazardous conditions, e.g. chemical manufacturing, transportation or chemical warfare. The second layer may comprise a film. The film may comprise e.g. polyurethane, polyether urethane film or a PVC film.

The second layer or film may be laminated to the fabric in various ways. For example, it may be heat sealed, applied by use of a hot melt adhesive film, sprayed on, or applied by a plurality of points of adhesive between the fabric and the second layer or film.

A third layer may be provided on the outer side of the second layer to protect the second layer. The third layer may comprise a fabric. Thus, a three layer laminate may be provided. The third layer may be flame retardant.

The porous layer may include a further layer secured thereto which, in use, is arranged to be adjacent to the body, such as in contact with the skin of a wearer.

Alternatively or additionally fluid, such as the majority of the fluid, may be arranged to be driven through a porous layer in the general extent of a layer which layer is arranged to be spaced from the skin of a wearer.

Any of the laminate constructions described herein may have one or more further layers laminated to achieve higher levels or flame retardency, heat blocking, thermal protection, and/or thermal warmth. The provision of an airgap may aid flame retardency. In this way, increased flame retardency may be provided by loosely attaching a thin layer over the top of the laminate. For example, a thin overall could be attached over the top of a suit made from the laminate.

As an alternative, or in addition, to the impermeable second layer, the structure of the fabric may be altered to provide an upper surface which is impermeable to the fluid driven in the porous layer to constrain the fluid therein. The fabric may be produced using a very tight knitted upper surface on the outer side to produce an impermeable layer with respect to the fluid. For example the upper surface may be airtight. Preferably, the upper surface still allows moisture vapour transmission. This may be achieved using micro or nano fibres in this layer. The fabric may also be altered to include a further protective layer for the tight layer. A full garment comprising the fabric may be produced by 3D modelling and knitting in one process. This process may use the altered 3D fabric structure, i.e. without the second layer or film. Alternatively, or in addition, the second/film layer may be sprayed on and/or a loose protective fabric outer layer may be used. Advantageously, this structure allows a garment to be knitted directly from a 3D computer body scan since the very tight knit layer provides the same impermeable effect as the second or film layer.

3D modelling may produce a seamless garment.

The fabric or clothing may include at least one fluid inlet through which fluid is arranged to pass in order that fluid can flow along the porous layer or layers. The fabric or clothing may include at least one outlet through which fluid that has passed through at least part of the porous layer or layers is arranged to exit the fabric or clothing.

The porous layer may have fibres extending across the porous layer arranged in a pattern to direct fluid passing along the porous layer. The pattern may be of various forms. The pattern may comprise one or more channels. The pattern may comprise one or more chambers. For example, the pattern of fibres may form a zigzag channel within the porous layer across the width of the fabric and/or along the length of the fabric. The pattern may comprise an initial channel that branches out and converges within the porous layer across the width of the fabric and/or along the length of the fabric. The patterned layer may be formed for example by programming a knitting machine to miss out fibres in defined areas to provide a channel through the fabric in that area. Advantageously, the channels can be used to direct the fluid though the material in a more defined manner which may aid cooling.

By altering the pattern of the cross fibre the flow rate within the fabric can be controlled. The fibres crossing around the channel area may be more numerous or frequent to restrict flow and force fluid into the channel. This may be used in particular areas of the suit, for example at the wrist to give the maximum cooling effect.

The fabric may be reinforced in areas where compression is high due to either folded areas during normal wear or the pressure of external equipment. For example, the fabric may have one or more reinforced channels in such areas of compression.

The edges and/or seams of the fabric and/or laminate may be sealed to form an impervious layer to contain the fluid. This can be achieved in various ways. For example sealing may be effected by inverting the edges, sewing and heat sealing the edges and/or by RF welding (Radio frequency welding, also known as dielectric or high frequency (HF) welding), and/or ultrasonic welding where wheels are used to press the seams together and ultra sound vibrates the wheels so rapidly that heat is generated to form a seamless weld.

The fluid is preferably arranged to be forced along the porous layer by external means. The fabric or clothing may include power means arranged to power fluid through the layer. The power means may be arranged to pull fluid through the layer or to drive fluid through the layer. The power means may be spaced from the fabric or clothing but connected thereto. For example, the power means may comprise an air pump system to pump air through the layer. The air pump system may be battery powered, and/or have automatic cut-off and/or other safety features. The fluid may be air ducted off from a vehicle's ventilation system and directed to be forced along the porous layer, either with no further forced assistance or with further powered assistance. There may be in addition natural air movement along the porous layer, when incorporated into clothing, because of: (a) body movement compressing and releasing areas of the laminate, and/or (b) convection of warm air moving into cooler areas of the porous layer.

The fluid may be arranged to be cooled, in order to aid cooling of the body. The fluid preferably comprises a gas such as air.

The clothing may comprise a full suit or cladding that covers part of the body only such as a glove, cuff, collar, thigh or chest region. The clothing may be located under a suit or may comprise the sole clothing for at least part of a wearers clothing.

The clothing, e.g. a full suit, may incorporate different areas of knit structure for different places in the, e.g., suit. This may provide areas of differing flexibility and/or shaping in areas such as underarms, shoulders, waist, crutch and knees. A more flexible knit structure for example may be achieved by altering the knit pattern, the stitch length and/or the yarn counts to give more stretch in one or both directions, increasing flexibility. For example, the under arm area may be given a more flexible knit structure and/or may be shaped to form an indented area to fit the under arm. The fabric can also be shaped by increasing and decreasing the number of stitches within given areas. Using weft knitting may provide the versatility to incorporate the aforementioned different areas of knit structure.

As indicated above, the suit design may incorporate areas of channeling, forcing more fluid through particular areas, such as the underarm for example. The channels may be reinforced in areas where the porous fabric is folded or under external pressure. Such reinforcement could be achieved, for example, by using more crossing fibre, higher yarn counts and/or by inserting additional reinforced material.

As there may be areas where the centre of the fabric or laminate will collapse (under seat belt straps, for example), it is beneficial to be able to channel the fluid to places where the system will be most effective.

According to a further aspect of the present invention a method of cooling the body comprises causing heat from the body to enter a porous layer of fabric, such as comprised in clothing, wherein the porous layer includes fibres extending across the porous layer, and powering fluid through the layer such that fluid is caused to flow along the layer to cause the fluid to take up heat from the layer.

The method may comprise permitting moisture from the body to be carried into the porous layer, such as by the moisture being wicked into the layer. The method may comprise the moisture travelling along fibres that comprise at least part of the layer. The method may comprise causing moisture to travel along fibres the majority of which extend more in the direction across the layer than in the direction along the layer.

Preferably the method include attracting the moisture vapour or sweat into the porous later, i.e. actively encouraging the moisture into the layer rather than merely permitting the moisture to enter the layer. This can be achieved by the arrangement of the fibres as described.

The method may comprise cooling the fluid prior to the fluid entering the porous layer. The method may comprise cooling the fluid to a temperature below the ambient temperature. The method preferably comprises powering gas such as air.

The method may comprise constraining the fluid to travel long the porous layer.

The method may comprise cooling the upper body or at least one arm or at least one leg or any combination thereof.

The present invention also includes a person wearing clothing when being cooled by the method as herein referred to.

The invention further provides other articles comprising the fabric, for example material for a vehicle seat comprising the fabric.

It is also possible for the fabric of the invention to be used to heat the body. This may be useful in applications where the body has been subjected to cold temperatures and requires efficient heating. For such applications, the fluid arranged to be driven along the porous layer may be further arranged to be of elevated temperature, e.g. with respect to the body, whereby heat exchange can occur in the opposite direction, with respect to cooling, through the lower surface of the fabric to heat the body. Accordingly, references herein to cooling the body include alternative references to heating the body.

The fabric may include a layer or layers incorporating infibre phase change microcapsules or coating a layer or layers with phase change microcapsules to store and release heat energy.

The present invention includes any combination of the herein referred to features or limitations.

The present invention can be carried into practice in many ways. Various embodiments will now be described, by way of example only, and with reference to the accompanying drawings, in which.

Figure 1:
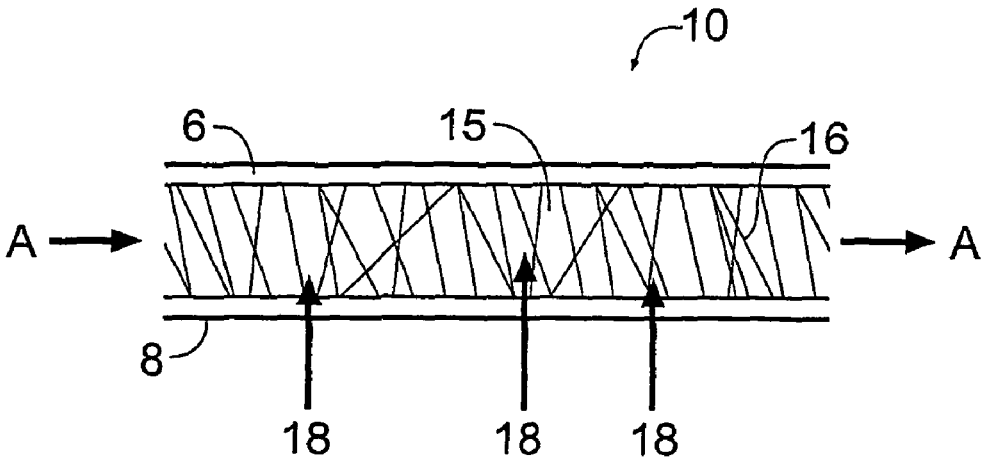
FIG. 1 is a side cross-section through a three dimensional fabric 10 according to the invention for use in clothing.

As shown in FIG. 1, the fabric 10 is made of fibres 16, or short yarn lengths, that extend predominantly across the layer, i.e. across the space 15 between upper and lower sides 6 and 8 of the fabric. The upper and lower sides 6 and 8 are also made of fibres. The whole fabric is knitted in one operation using weft knitting. The porous layer extends along the fabric. The lower side 8, which is on the body side, at least is permeable to moisture, heat and air from a body. The fibres 16 are be generally straight in their extent but may vary in the direction that they extend along their length. The majority of the fibres 16 have their extent along their length more in the direction across the layer than along the extent of the layer. Substantially all of the fibres 16 extend in a direction across the fabric. Air gaps 18 are provided between the fibres and in particular the air gaps 18 are greater across the fabric than along the fabric. The fabric is from around 3 mm to 6 mm in depth.

The fibres 16 that extend predominantly across the layer are polyester monofilament. The upper and lower faces are of NOMEX yarn (Trade Mark). However, a flame retardant monofilament, if available, would be preferred for the cross fibres 16 in order to increase the flame retardency of the fabric as a whole.

Alternatively or additionally the fibres may be treated such that they are flame retardant, or may be inherently flame retardant.

The fabric is knitted according to the following specification and according to the structure shown in

FIG. 7 #1-6:

NP (needles per inch) of Ground knit (upper and lower surfaces): 10.0

NP of Tuck (crossing yarn): 9.0

Takedown: 12

Knit System: Optimum

In use, air is driven along the layer in the direction of arrow A.

Figure 2:
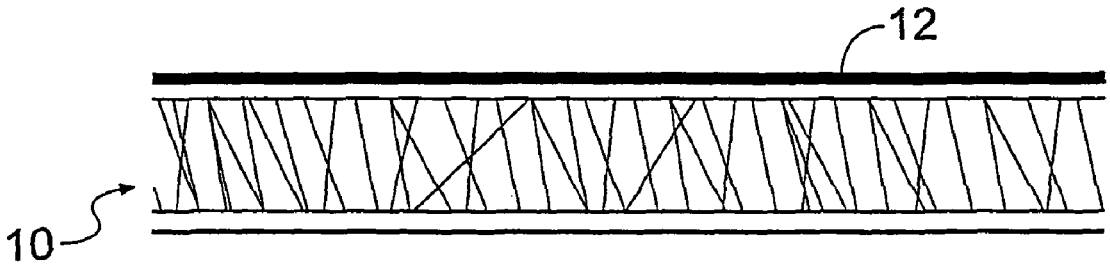
FIG. 2 is a view of the fabric 10 shown in FIG. 1 including a film 12 laminated to one side.

FIG. 2 shows a film 12 comprising polyester urethane laminated to the outerside of the fabric 10. The film 12 is formed separately prior to securing the film to the fabric, and then the film is adhered using a hot melt adhesive film. Alternatively, the film 12 may be otherwise attached to the fabric. Alternatively, the film 12 may be formed on the fabric such as by coating liquid film over the fabric. The film is a hydrophilic film arranged to attract moisture away from a wearers body. The film 12 is arranged to constrain air flow to be largely within the fabric, i.e. it is substantially air-tight.

If desired, the opposite side of the fabric that has the film 12 laminated to it may be treated or laminated with a different film such that that side, which is arranged to be adjacent to the body of a wearer, does not unduly irritate the skin of the wearer. Alternatively or additionally the fabric may be knitted to an adjacent layer, which may be arranged to be adjacent to the skin of a wearer. That adjacent layer may have the majority of the fibres extending in the general extent of the layer rather than across the layer.

Figure 3:
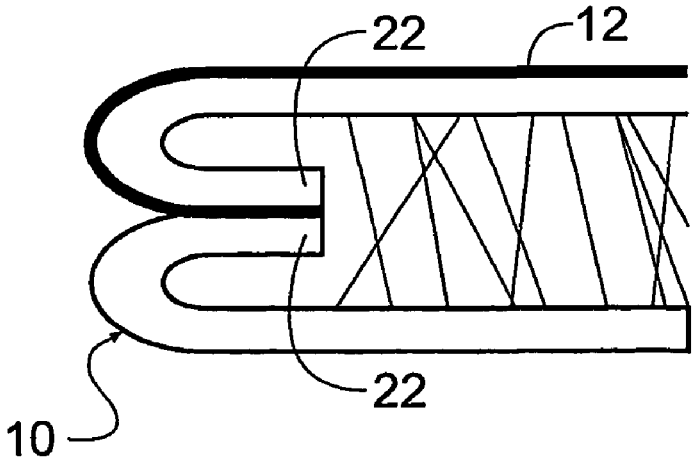
FIG. 3 is a cross-section of a joint 14 of two portions of clothing according to the invention.
Figure 4:
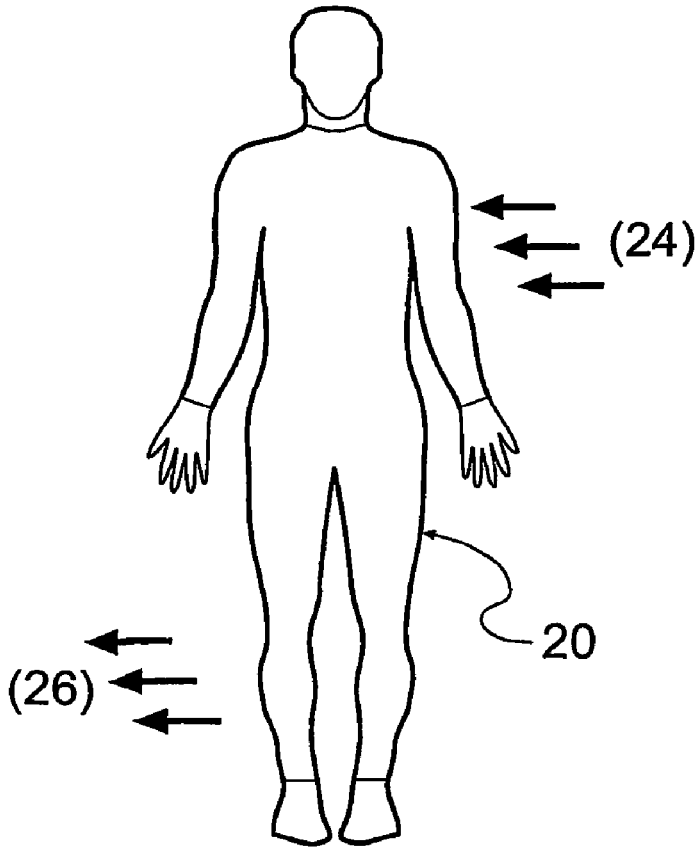
FIG. 4 is a schematic diagram of a person wearing a suit made out of the laminated fabric according to the invention.

The fabric 10 or laminate as shown in FIG. 2 can be formed into a tight fitting suit 20, as shown in FIG. 4. The suit is fireproof. At the same time, the suit 20 provides cooling to the body yet is lightweight and flexible. The suit 20 is provided with tight fitting cuffs at the neck, wrists and ankles such that it is almost a sealed unit. Edges of the fabric that make up the suit are sealed, as shown in FIG. 3. The edges 22 are turned in such that their previously outwardly facing surfaces now face each other and are bonded to each other. In use, the wearer of the suit 20 will sweat and that moisture and heat will be carried into the fabric 10. The moisture readily enters the fabric 10 through the lower side 8 and it is wicked along the fibres 16, away from the skin.

The suit is provided with air inlets 24 and air outlets 26 which are shown schematically in. FIG. 4. More or less inlets and outlets may be provided than those shown and the inlets or outlets or both may be provided at multiple locations or different locations to those shown. Air to the inlets is driven by a pump (not shown) which causes the air to be driven through the fabric to take up at least a part of the sweat in the fabric and to cool the fabric in order for a heat exchange to take place and thereby cool the body. Alternatively, a pump may be used to draw air through the outlets to achieve the same effect. The warmer, moist air exits through the suit outlets 26. Thus the body of the user is able to continue to sweat to lose heat effectively and a manageable body temperature is able to be maintained.

Optionally, the air can be cooled prior to entering the fabric in order to enhance the cooling effect. If desired, gas other than air can be used.

Whilst the cross-section of the suit has been described with the three dimensional fabric having a film 12 on the outside various other embodiments are possible. For instance, the following combinations of layers, in cross section, starting with the layer adjacent to the skin, are possible:

1. 3D fabric to film to 3D fabric.
2. 3D fabric to film to 3D fabric to one or more layers of other fabrics.
3. 3D fabric to film to one or more layers of other fabrics.

Examples of specific laminates include the following:

a. 3D fabric to a microporous polyether urethane film.
b. 3D fabric to a polyurethane film.
c. 3D fabric to a PVC film.

Figure 5:
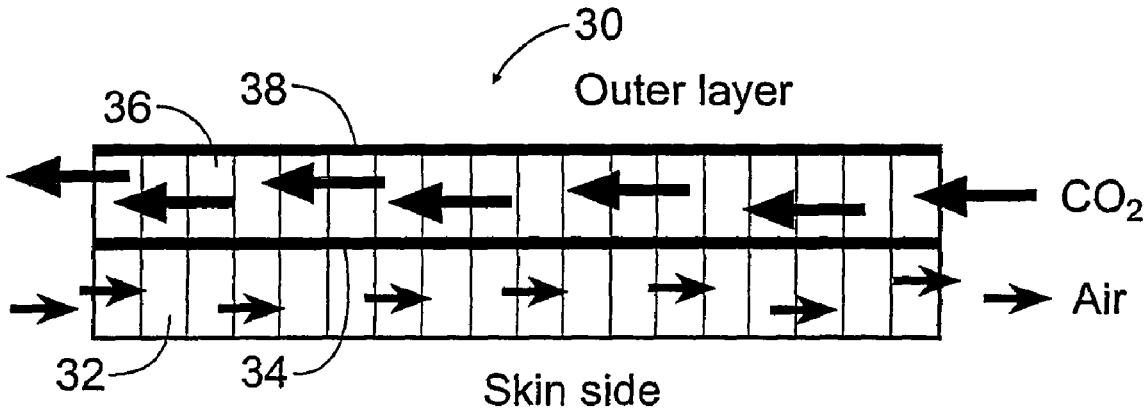
FIG. 5 shows a laminate according to the invention having two porous layers.

An example of a further embodiment is shown in FIG. 5. The laminate 30 comprises four layers in which, starting from the layer closest the body (indicated as skin side) the first layer 32 comprises the 3D fabric with porous layer, the second layer 34 is an air impermeable layer comprising the film 12 which allows moisture vapour transmission, the third layer 36 is another 3D fabric with porous layer and the fourth layer 38 is another air impermeable layer comprising the film 12 which allows moisture vapour transmission. Optionally a fifth layer which comprises a fabric may be provided on the fourth layer to protect the outer impermeable layer. The at least four layer laminate may be used with air circulating in the first porous layer 32 to cool the body as above described, with the second porous layer 36 having an inert gas, such as $CO_2$, circulating to protect the body if engulfed in a fire or high temperature environment. If having a gas such as $CO_2$ circulating continuously in the layer tends to cool the body too much such that freezing of the wearer's skin becomes a problem, the laminate may be arranged such that the second porous layer 36 is connected to a source of inert gas which can be activated to flood the second porous layer 36 only when needed, e.g. in the event of a fire, rather than have the inert gas circulating continuously.

Figure 6A:
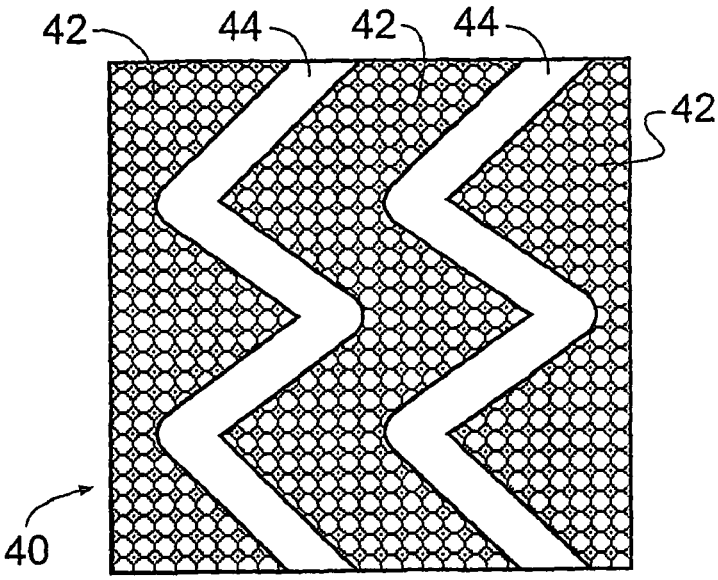
FIG. 6 shows schematically, in plan view, various patterns of fibres within a porous layer.
Figure 6B:
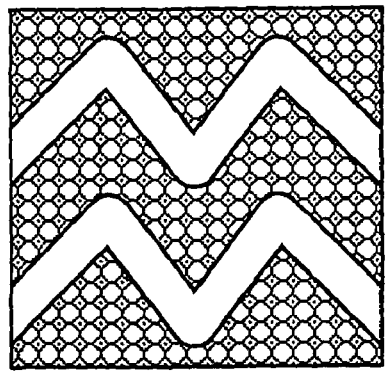
Figure 6C:
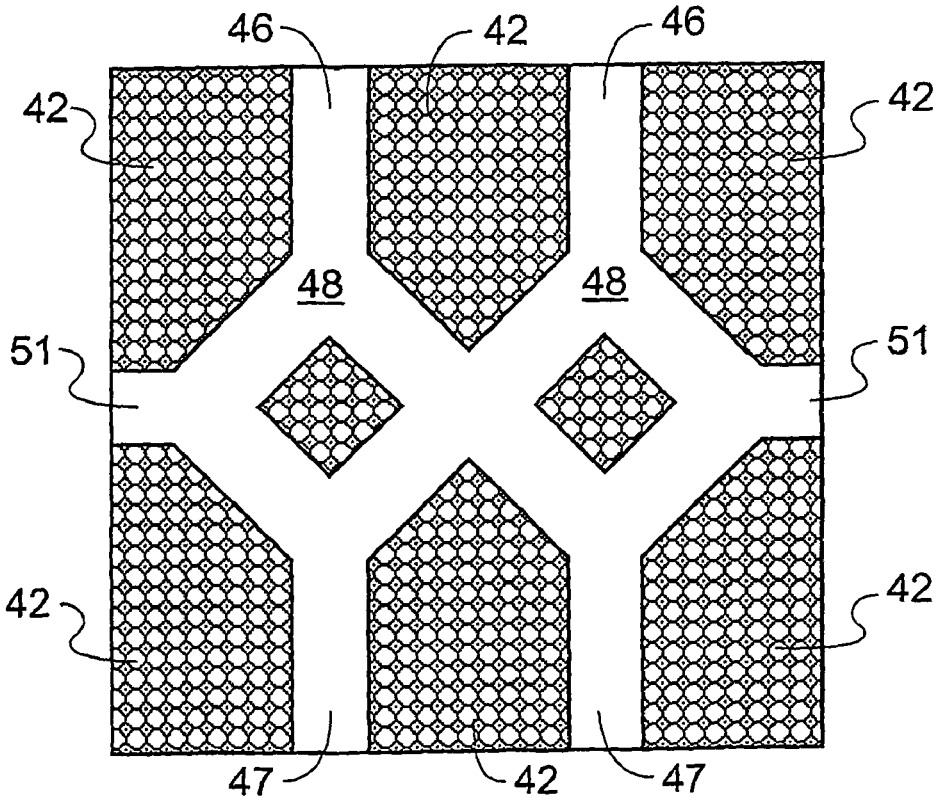
Figure 7:
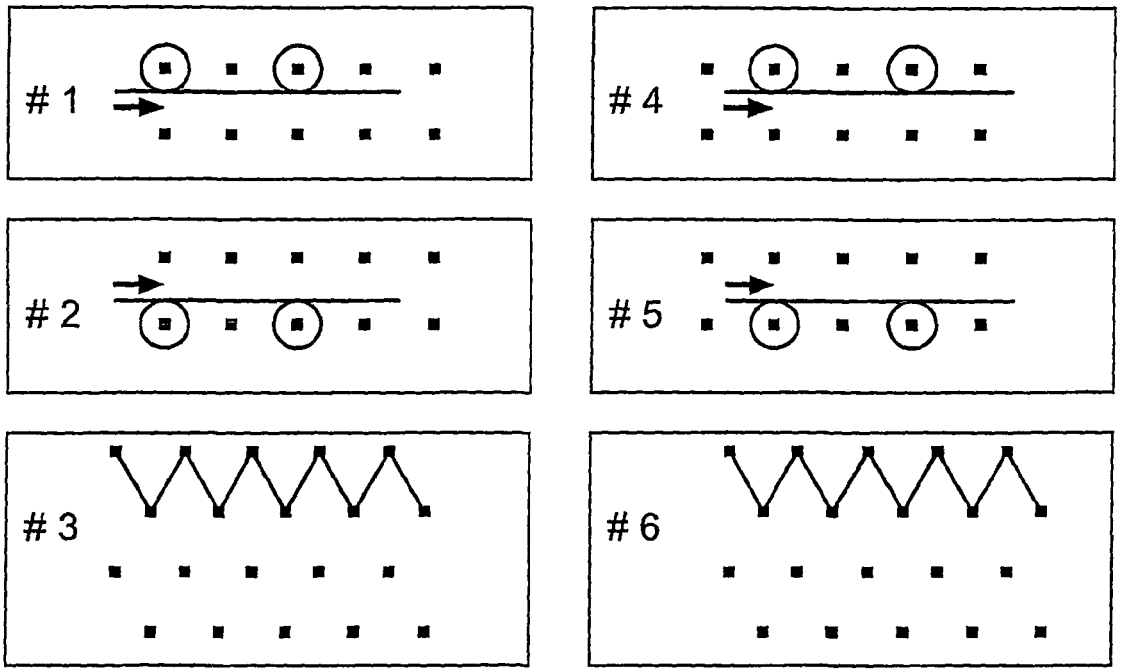
FIG. 7 shows a knitting sequence for a fabric according to the invention.

The cooling of the clothing may be controlled by programming the knitting machine which makes the fabric to miss out cross fibres 16 in defined areas to provide one or more channels through the fabric. The channels through the fibres direct fluid passing along the porous layer in a defined manner such that cooling can be better directed to certain areas. Various examples of such patterned layers are shown in FIGS. 6A-C. FIG. 6A shows in sectional plan view a fabric 40 having areas 42 where cross fibres 16 are of normal density and areas 44 in which the fibres have been missed out to define zigzag channels. The channels may be directed in any direction in the suit and FIG. 6B shows for example the zigzag channels of FIG. 6A but extending at 90 degrees thereto. In FIG. 6C is shown a pattern comprising initial channels 46 that branch out into chambers 48 which converge again to channels 47. Side channels 51 lead from the chambers 48. Air driven through the porous layer will be restricted in areas 42 where the cross fibres are present and instead preferentially forced down the channels. The cooling can therefore be controlled more to certain areas of the suit e.g. the wrist area where greater cooling may be required.

The following may be considered potential users of a suit made from the fabric or laminate in addition to drivers:

Application(s) User(s)

Fire protection Firefighters/MoD etc

Gas/Chemical protection Chemical workers/MoD etc (when a gas and/or chemical resistant film is incorporated in the laminate)

General heat (rather than fire) Workers operating in high temperatures needing maximum freedom of movement Although the example above has been described in relation to a suit it will be appreciated that other items of clothing could be made. For instance, gloves, cuffs or collars could have any of the features described. In addition, other specific areas could be cooled and thus a chest or thigh cladding could be attached to the body to cool those areas.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A fabric comprising a central porous layer that is porous in the direction along the layer, the central porous layer including straight fibres with some fibres extending substantially transversely completely across the layer and other of the fibers extending diagonally along the layer in the direction thereof, with more of the fibres extending from one end to the other across the central porous layer than extend from one end to the other along the central porous layer, whereby, in use, fluid may be driven along the central porous layer with space separating the fibers defining one or more channels through the central porous layer for preferential fluid flow through the channels in the direction along the layer with at least one of the channels having a segment of zigzag configuration.

2. A fabric as claimed in claim 1, wherein the fabric comprises an upper surface and, spaced therefrom, a lower surface, the central porous layer being provided therebetween.

3. A fabric as claimed in claim 2, wherein the lower surface, in use, is adjacent to a body.

4. A fabric as claimed in claim 2, wherein the lower surface is permeable to the fluid.

5. A fabric as claimed in claim 2, wherein the lower surface is permeable to moisture.

6. A fabric as claimed in claim 1, wherein the central porous layer has on its upper side a layer which is impermeable to the fluid driven in the central porous layer thereby to constrain the fluid to move along the central porous layer and the central porous layer has located on its lower side an air impermeable, moisture vapor permeable film.

7. A fabric as claimed in claim 6, wherein an upper surface of the central porous layer is fluid impermeable and formed by tight knitting of the upper surface.

8. A fabric as claimed in claim 6, wherein the impermeable surface comprises a layer laminated to the upper surface of the fabric.

9. A fabric as claimed in claim 1, wherein the central porous layer includes one or more fibre(s) selected from the group comprising staple fibres, elongate fibres, continuous filaments or monofilament(s).

10. A fabric as claimed in claim 9, wherein the fibre(s) comprises a monofilament.

11. A fabric as claimed in claim 9, wherein the fibre(s) comprises polyester.

12. A fabric as claimed in claim 9, wherein the fibre(s) comprises flame retardant fibre, treated flame retardant fibre or a combination thereof.

13. A fabric as claimed in claim 9, wherein the fibre(s) is or are knitted, needled or woven.

14. A fabric as claimed in claim 1, wherein the upper and lower surfaces of the fabric comprise fibres selected from the group comprising staple fibres, elongate fibres, continuous filaments or monofilament(s).

15. A fabric as claimed in claim 14, wherein the fibres of the upper and lower faces comprise fibres selected from the group comprising inherent flame retardant fibres, treated flame retardant fibres, treated cotton, natural fibres, man made fibres and/or a combination of different fibres in both upper and lower surfaces.

16. A fabric as claimed in claim 1, wherein the surface in use next to the body includes fibres with wicking properties.

17. A fabric as claimed in claim 1, wherein the fibres comprising the porous layer and the upper and lower surfaces are needled, knitted or woven as a single fabric.

18. A fabric as claimed in claim 1, wherein the fabric comprises warp or weft knitting.

19. A fabric as claimed in claim 18, wherein the fabric comprises weft knitting and the upper and lower surfaces include a plain knit, single jersey or double jersey.

20. A fabric as claimed in claim 18, wherein the cross fibres are knitted into the upper and lower surfaces on an alternative side sequence.

21. A fabric as claimed in claim 1, wherein the porous layer is formed by knitting in one operation in which the upper and lower surfaces are knitted simultaneously and the cross fibre of the porous layer is passed singly from the upper to the lower surface.

22. A fabric as claimed in claim 21, wherein the cross fibre is knitted into each surface as it passes across.

23. A fabric as claimed in claim 22, wherein the cross fibre comprises a single yarn and each pass is a single pass.

24. A fabric as claimed in claim 18, wherein the fabric is formed by weft knitting using a knitting sequence of (1) stitch loop formation, (2) the cross fibre crosses to opposite side and is laid into the opposite side stitch loop, (3) the opposite stitch loop is formed, (4) the cross fibre is then passed back to the original side and laid into the stitch loop, followed by repeating of the sequence.

25. A fabric as claimed in claim 1, wherein at least part of the lower surface of the porous layer, or a porous fabric attached thereto, is arranged, in use, to contact the skin of a user over at least part of its extent.

26. A fabric as claimed in claim 8, wherein the laminated layer comprises a film.

27. A fabric as claimed in claim 8, wherein the laminated layer, comprises a hydrophilic layer or membrane.

28. A fabric as claimed in claim 27, wherein the hydrophilic layer or membrane, in use, is arranged to attract moisture from inside the fabric and through the hydrophilic layer or membrane.

29. A fabric as claimed in claim 8, wherein the laminated layer comprises a flame retardant layer.

30. A fabric as claimed in claim 8, wherein the laminated layer comprises a material selected from the group comprising polyurethane, polyester urethane or PVC films.

31. A fabric as claimed in claim 8, wherein a third layer is provided on the outer side of the laminated layer to protect the laminated layer.

32. A fabric comprising a porous layer that is porous in the direction along the layer, the porous layer including fibers extending across the layer, whereby in use fluid is arranged to be driven along the porous layer, characterized in that the cross fibers are arranged in a pattern to provide one or more channels through the fabric for preferential fluid flow through the one or more channels in the direction along the layer;

wherein the porous layer has located adjacent to it on its upper side an impermeable layer or surface which is impermeable to the fluid driven in the porous layer thereby to constrain the fluid to move along the porous layer; wherein the impermeable layer or surface comprises a layer laminated to the upper surface of the fabric; and wherein a further porous layer is provided on the laminated layer such that the laminated layer is located between two porous layers.

33. A fabric as claimed in claim 32, wherein both of the porous layers, in use, are arranged to have fluid driven through them in the general direction of the layer.

34. A fabric as claimed in claim 32, wherein a further laminated layer is provided on the further porous layer, and a fifth layer is provided on the further laminated layer, which comprises a fabric to protect the further laminated layer.

35. A fabric as claimed in claim 32, wherein in use the fabric is arranged for a first fluid to be circulating in the first porous layer and the second porous layer is arranged to carry a second fluid.

36. A fabric as claimed in claim 35, wherein each of the first and second fluids comprises a gas.

37. A fabric as claimed in claim 36, wherein the gas comprises air.

38. A fabric as claimed in claim 35, wherein the second fluid comprises an inert gas.

39. A fabric as claimed in claim 32, wherein the fabric includes at least one fluid inlet through which the fluid is arranged to pass in order that the fluid can flow along the porous layer or layers and at least one outlet through which the fluid that has passed through at least part of the porous layer or layers is arranged to exit the fabric.

40. A fabric as claimed in claim 32, wherein the fibres extending across the porous layer are arranged in a pattern to direct fluid passing along the porous layer.

41. A fabric as claimed in claim 40, wherein the pattern comprises one or more channels and/or one or more chambers.

42. A fabric as claimed in claim 1, wherein in use the fluid is arranged to be forced along the porous layer by power means.

43. An article comprising the fabric as claimed in claim 1.

44. An article as claimed in claim 43, which is an article of clothing.

45. An article of clothing as claimed in claim 44, which comprises a suit or cladding that covers part of the body only.

46. An article of clothing as claimed in claim 45, which comprises a glove, cuff, collar, thigh or chest part.

47. An article of clothing as claim in claim 44, wherein the clothing comprises different areas of knit structure for different places in the clothing.

48. An article of clothing as claimed in claim 47, wherein the clothing comprises different areas of fluid channeling, to force more fluid through particular areas.

49. An article as claimed in claim 48, which is a vehicle seat.

50. A fabric comprising:

a. a central layer that is porous in the direction along the layer, the central porous layer made of straight fibers with some of the fibers being skew to the direction of the layer and extending entirely across the entire width of the porous central layer, with more of the fibers extending from one end to the other across the central porous layer than extend from one end to the other along the central porous layer, so that fluid may be driven through the central porous layer with the fibers spaced one from another to provide at least one channel through the central porous layer for fluid flow through the channels in a direction along the central porous layer;

b. the central porous layer having adjacent to it on its upper side a first film laminated to the upper surface of the central porous layer, which film is impermeable to fluid driven through the channels in the porous layer thereby to constrain the fluid to move along the porous layer;

c. a second film contacting a surface of the central porous layer that is opposite from the surface contacted by the impermeable layer; and d. a porous lower layer contacting the second film on the side opposite that of the central porous layer.

51. The fabric of claim 50 wherein at least one channel within the central porous layer zigzags across at least a portion of the width of the central porous layer.

52. The fabric of claim 50 wherein at least one channel within the central porous layer zigzags across the entire width of the central porous layer.

53. The fabric of claim 50 wherein at least one channel within the central porous layer zigzags along at least a portion of the length of the central porous layer.

54. The fabric of claim 50 wherein at least one channel within the central porous layer zigzags along the entire length of the central porous layer.

55. The fabric of claim 50 wherein at least one channel within the porous layer zigzags along at least a portion of the length of the porous layer and across at least a portion of the width of the porous layer.

56. The fabric of claim 50 wherein more of the fibers extend from one end to the other across the porous layer than extend from one end to the other along the porous layer.

57. A fabric comprising:

a. a central layer that is porous in the direction along the layer, the central porous layer made of straight fibers with some of the fibers being skew to the direction of the layer and extending entirely across the entire width of the porous central layer so that fluid may be driven through the porous layer with the fibers spaced one from another to provide at least one channel through the central porous layer that zigzags along at least a portion of the length of the central porous layer for fluid flow through the channels in a direction along the central porous layer;

b. the central porous layer having adjacent to it on its upper side a first film laminated to the upper surface of the central porous layer, which film is impermeable to fluid driven through the channels in the porous layer thereby to constrain the fluid to move along the porous layer;

c. a second film contacting a surface of the central porous layer that is opposite from the surface contacted by the impermeable layer; and d. a porous lower layer contacting the second film on the side opposite that of the central porous layer.

58. The fabric of claim 57 wherein at least one channel within the porous layer zigzags across at least a portion of the width of the porous layer.

* * * * *